US006702654B2

(12) United States Patent
Nanda et al.

(10) Patent No.: US 6,702,654 B2
(45) Date of Patent: Mar. 9, 2004

(54) CONDITIONING WHEEL FOR CONDITIONING A SEMICONDUCTOR WAFER POLISHING PAD AND METHOD OF MANUFACTURE THEREOF

(75) Inventors: Arun K. Nanda, Orlando, FL (US); Jose Omar Rodriguez, Orlando, FL (US); Laurence D. Schultz, Kissimmee, FL (US); Charles A. Storey, Orlando, FL (US)

(73) Assignee: Agere Systems Inc., Allentown, PA (US)

( * ) Notice: Subject to any disclaimer, the term of this patent is extended or adjusted under 35 U.S.C. 154(b) by 85 days.

(21) Appl. No.: 09/778,986

(22) Filed: Feb. 7, 2001

(65) Prior Publication Data

US 2002/0106979 A1 Aug. 8, 2002

(51) Int. Cl.[7] ..... B24B 1/00

(52) U.S. Cl. ..... 451/56; 451/72; 451/443; 451/533; 451/539; 29/423; 29/460; 51/295

(58) Field of Search ..... 451/56, 72, 443, 451/533, 539, 527; 29/423, 460; 51/295

(56) References Cited

U.S. PATENT DOCUMENTS

| | | | | |
|---|---|---|---|---|
| 5,885,132 A | * | 3/1999 | Meyer | 451/6 |
| 6,306,025 B1 | * | 10/2001 | Torii | 451/443 |
| 6,347,982 B1 | * | 2/2002 | Holzapfel | 451/56 |
| 6,368,198 B1 | * | 4/2002 | Sung et al. | 451/443 |
| 6,447,374 B1 | * | 9/2002 | Sommer et al. | 451/56 |

* cited by examiner

*Primary Examiner*—Joseph J. Hail, III
*Assistant Examiner*—Alvin J Grant

(57) ABSTRACT

The present invention provides an improved conditioning wheel for conditioning polishing pads used to polish semiconductor wafers. In one embodiment, the conditioning wheel includes a planar body having a metal surface located thereon. The metal surface has abrasive particles embedded therein and a retainer coating deposited over the metal surface and the abrasive particles. The retainer coating inhibits the abrasive particles from dislodging during a conditioning process.

13 Claims, 2 Drawing Sheets

CONDITIONING WHEEL FOR CONDITIONING A SEMICONDUCTOR WAFER POLISHING PAD AND METHOD OF MANUFACTURE THEREOF

TECHNICAL FIELD OF THE INVENTION

The present invention is directed, in general, to a conditioning wheel for a semiconductor wafer polishing pad and, more specifically, to a conditioning wheel that has a retainer coating deposited over the abrasive particles that inhibit the abrasive particles from dislodging from a surface of the conditioning wheel during a conditioning process.

BACKGROUND OF THE INVENTION

In the manufacture of the integrated circuits (ICs) derived from semiconductor wafers, chemical-mechanical planarization (CMP) is used to provide smooth topographies of the wafer substrates on which ICs are formed for subsequent lithography and material deposition.

Unfortunately, during the CMP process the polishing pad often collects particulate material from the slurry, as well as byproducts from the polishing process. Over time, this material begins to clog the pad, inhibiting the CMP process. When the pad becomes clogged, it becomes necessary to condition the pad in order to restore its original shape and properties. That is, the material must be removed before it completely clogs the pad and results in a surface that does not effectively polish the semiconductor wafer, or a surface that scratches or otherwise damages the wafer. In short, to properly polish a semiconductor wafer, the performance of the polishing pad should not be compromised.

In conventional processes, to condition the polishing pad, a conditioning wheel with a surface of diamond abrasives embedded in a nickel/stainless steel alloy setting is used. Referring initially to FIG. 1, illustrated is a polishing pad conditioning wheel 100 found in the prior art. The conditioning wheel 100 includes a planar body 110 and an upper surface 120, typically composed of metal or a metal alloy, for conditioning a semiconductor wafer polishing pad (not illustrated).

The upper surface 120 of the conditioning wheel 100 includes abrasive particles, one of which is designated 140, that are embedded in the upper surface 120. The abrasive particles 140 are typically diamond crystals. These diamond crystals are well suited for conditioning the polishing surface of a polishing pad, which must be done periodically to keep the polishing pad at optimum polishing efficiency.

As the conditioning wheel 100 is repeatedly used, its effectiveness at reconditioning the surface of a polishing pad decreases. Perhaps the most common reason for this decrease may be that the abrasive particles 140 become worn and rounded, losing their polishing effectiveness. However, a more pressing concern for this degradation may be that the abrasive particles 140 in the upper surface 120 become lose and fall out of the upper surface 120 of the conditioning wheel 100, as illustrated by arrow 150. Of course, this reduces the effective surface area of the conditioning wheel 100 and slows the conditioning process. Moreover, this condition becomes even more pressing if many abrasive particles 140 are lost from a single area of the upper surface 120. In such a case, the conditioning wheel 100 may begin to condition a polishing pad unevenly, which may translate into damaging or unevenly polishing a semiconductor wafer undergoing the CMP process. Once dislodged, the abrasive particles 140 that fall from the conditioning wheel 100 cannot be replaced with new particles. In time, when a substantial number of abrasive particles 140 have been lost, the capabilities of the conditioning wheel 100 are so lost that it must be replaced with a new one, usually at significant costs.

Perhaps more importantly, the loss of abrasive particles 140 during the conditioning process is not only undesirable from a cost standpoint, but also from a quality standpoint as the abrasive particles 140 can become embedded in the polishing pad just conditioned. Once embedded in the polishing pad, the abrasive particles 140 will easily scratch a semiconductor wafer undergoing CMP, in some cases damaging it beyond repair. With the high cost of semiconductor materials, manufacturers are understandably eager to avoid damaging, and thus, discarding wafers during the CMP process.

Accordingly, what is needed in the art is an improved conditioning wheel for conditioning a semiconductor wafer polishing pad that does not suffer from the deficiencies found in the prior art.

SUMMARY OF THE INVENTION

To address the above-discussed deficiencies of the prior art, the present invention provides an improved polishing pad conditioning wheel. In one embodiment, the conditioning wheel includes a planar body having a metal surface located thereon. The metal surface has abrasive particles embedded therein, and a retainer coating deposited over the metal surface and the abrasive particles. The retainer coating inhibits the abrasive particles from dislodging during a conditioning process. The retainer coating includes a wide range of coatings that would inhibit the abrasive particles from dislodging from the condition wheel.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
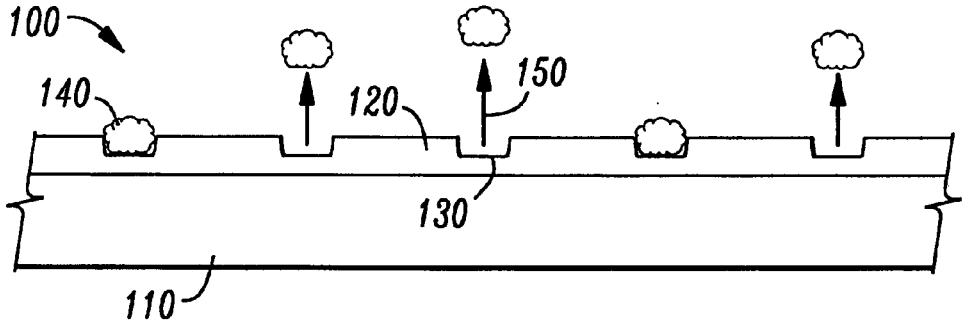
FIG. 1 (PRIOR ART)
FIG. 1 illustrates a sectional view of a polishing pad conditioning wheel found in the prior art.
Figure 2:
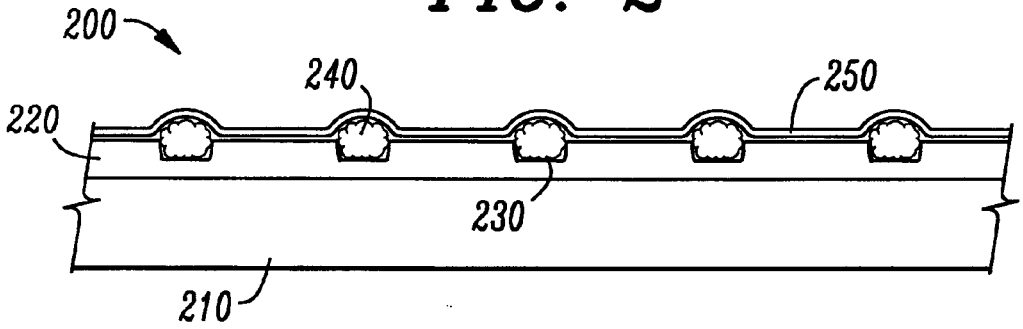
FIG. 2 illustrates a sectional view of a polishing pad conditioning wheel manufactured according to the principles of the present invention.

Referring now to FIG. 2, there is illustrated an advantageous embodiment of a polishing pad conditioning wheel 200 as covered by the present invention. The conditioning wheel 200 includes a planar body 210 and an upper surface 220. In a particularly advantageous embodiment, the planar body 210 has an annular configuration, however the present invention is broad enough to encompasses other geometric configurations. In such an embodiment, the conditioning wheel 200 conditions a polishing pad (not illustrated) by rotating against and across the pad's polishing surface.

In the illustrated embodiment, the upper surface 220 is a metal surface, and in an advantageous embodiment is composed of a nickel-chrome alloy. In an alternative embodiment, the upper surface 220 may be composed of stainless steel, however a conditioning wheel 200 according to the present invention is broad enough to encompass any material suitable for use in the upper surface 220 of the planar body 210 that is capable of retaining abrasive particles.

The upper surface 220 of the conditioning wheel 200 also includes abrasive particles, one of which is designated 240, that are embedded in the upper surface 220. In an exemplary embodiment, the abrasive particles 240 are diamond particles, however, other abrasive particles capable of conditioning a polishing pad, such as silicon carbide particles, may be used as the abrasive particles 240.

The conditioning wheel 200 of the present invention further includes a retainer coating 250 that is located over the upper surface 220 and the abrasive particles 240. The retainer coating 250 secures the abrasive particles 240 to the upper surface 220 and may, depending on the material, also provide an abrasive component. The retainer coating 250 also inhibits the abrasive particles 240 from becoming dislodged during conditioning of a polishing pad. Since the retainer coating 250 inhibits the abrasive particles 240 from falling from the upper surface 220, the conditioning effectiveness of the conditioning wheel 200 remains high and the conditioning wheel 220 need only be replaced when the abrasive particles 240 are so worn they can no longer effectively condition a polishing pad. In a particularly advantageous embodiment of the conditioning wheel 200, diamond particles are used as the abrasive particles 240 because of the superior wear-resistance. Because of this superior wear-resistance, the diamond particles could effectively condition substantially more polishing pads than conditioning wheels found in the prior art before the need to be replaced since the abrasive particles 240 would be securely held in place by the retainer coating 250.

In one aspect of the conditioning wheel 200, the retainer coating 250 is also composed of diamond. In this embodiment, the diamond coating 250 not only inhibits the abrasive particles 240 from becoming dislodged from the upper surface 220, but also provides another abrasive surface for use in conditioning polishing pads. In fact, in a related embodiment the retainer coating 250 composed of diamond may even replace the abrasive particles 240 as the abrasive used to condition a polishing pad. This diamond coating may be deposited by a chemical vapor process. In such embodiments, the retainer coating 250 is a chemical vapor deposition diamond (CVD diamond) coating. As used with regard to the present invention, CVD diamond is defined as the deposition or growth of diamond crystals on a surface, through a chemical vapor deposition (CVD) process, which results in a microcrystalline diamond film forming on the surface. In this embodiment, to create the CVD diamond coating, CVD diamond is deposited onto the upper surface 220 of the conditioning wheel 200 through a CVD process. Those skilled in the art are familiar with such CVD process, as well as the tendency of the CVD process to create an ultra-thin film that closely follows the topography of the deposition surface. A conditioning wheel 200 having a CVD diamond coating as the retainer coating 250 also provides an additional abrasive surface, or, alternatively, a replacement abrasive surface, similar to the exemplary embodiment discussed above.

In yet another advantageous embodiment, the retainer coating 250 may be composed of silicon carbide. In this particular embodiment, the silicon carbide retainer coating 250 still inhibits the abrasive particles 240 from becoming dislodged from the upper surface 220, and those skilled in the art are familiar with the advantages associated with the use of silicon carbide, such as increased wear-resistance and increased heat resistance. In one aspect of this particular embodiment, the silicon carbide coating may be a chemical vapor deposition silicon carbide (CVD silicon carbide) coating. As used with regard to the present invention, CVD silicon carbide is defined as the deposition or growth of silicon carbide on a surface, through a CVD process, which results in a silicon carbide film forming on the surface. Like the diamond coatings discussed above, the CVD silicon carbide coating also inhibits the abrasive particles 240 from becoming dislodged from the upper surface 220, thus significantly extending the useful life of the conditioning wheel 200 above that of the prior art, and it also provides another abrasive surface that can be used to condition a polishing pad.

In view of the disclosed embodiments, one skilled in the art can see that a conditioning wheel 200 having a retainer coating 250 according to the principles of the present invention provides numerous advantages over wheels found in the prior art. Among the most significant advantages is preventing the contamination of polishing pads by inhibiting dislodging of the abrasive particles 240 during polishing pad conditioning. By inhibiting dislodging of the abrasive particles 240, the conditioning wheel 200 provides the protection against scratching or otherwise damaging semiconductor wafers undergoing CMP unavailable in the prior art. Of course, the present invention also provides other important advantages including incorporating known CVD processes that result in a retainer coating 250 that will closely follow the surface topography, thus substantially maintaining the original abrasiveness of the upper surface 220. In addition, the retainer coating 250 further provides an increased wear-resistance of its own. Specifically, the hardness of the retainer coating 250, especially in embodiments using CVD diamond, provides extra life for the conditioning wheel 200 since the retainer coating 250 must first be worn before the abrasive particles 240 begin to wear. Furthermore, where conditioning wheels in the prior art cannot be repaired and reused once the abrasive particles are lost, the conditioning wheel 200 of the present invention may easily have a new retainer coating 250 replace a prior coating when it has excessively worn. Yet another advantage of the retainer coating 250 of the present invention is its ability to continue to provide support for the abrasive particles 240, even after the retainer coating 250 becomes worn by repeated conditioning operations. This benefit will be described in greater detail with reference to FIG. 3.

Figure 3:
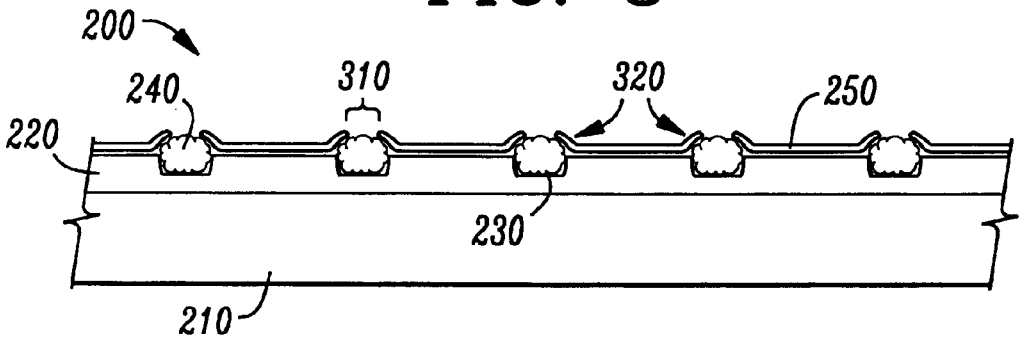
FIG. 3 illustrates a sectional view of the polishing pad conditioning wheel of FIG. 2 having a worn retainer coating.

Referring now to FIG. 3, there is illustrated the polishing pad conditioning wheel 200 of FIG. 2 having a worn retainer coating 250. The conditioning wheel 200 still includes the planar body 210 and upper surface 220 in which the abrasive particles 240 are embedded. The retainer coating 250 is again illustrated as deposited over the abrasive particles 240 and the upper surface 220 of the conditioning wheel 200.

As illustrated, the retainer coating 250 of the conditioning wheel 200 has been worn away at the crests 310 of the abrasive particles 240. These worn portions of the retainer coating 250 leave the crests 310 of the abrasive particles 240 exposed, and thus become the only portions of the conditioning wheel 200 used to condition a polishing pad (not illustrated). However, although the crests 310 of the retainer coating 250 are worn away, the retainer coating 250 still forms support walls 320 on each side of the abrasive particles 240. As a result, the support walls 320 continue to secure the abrasive particles 240 in the upper surface 220, thus continuing to inhibit them from becoming dislodged and possibly contaminating the CMP process of a semiconductor wafer.

In a particularly advantageous embodiment of the conditioning wheel 200, the support walls 320 are capable of securing the abrasive particles 240 in the upper surface 220 until the abrasive particles 240 become too worn to effectively condition a polishing pad. In such an embodiment, the life of the conditioning wheel 200 is greatly extended, with a substantially reduced risk of contaminating the CMP process with loose abrasive particles 240.

Figure 4A:
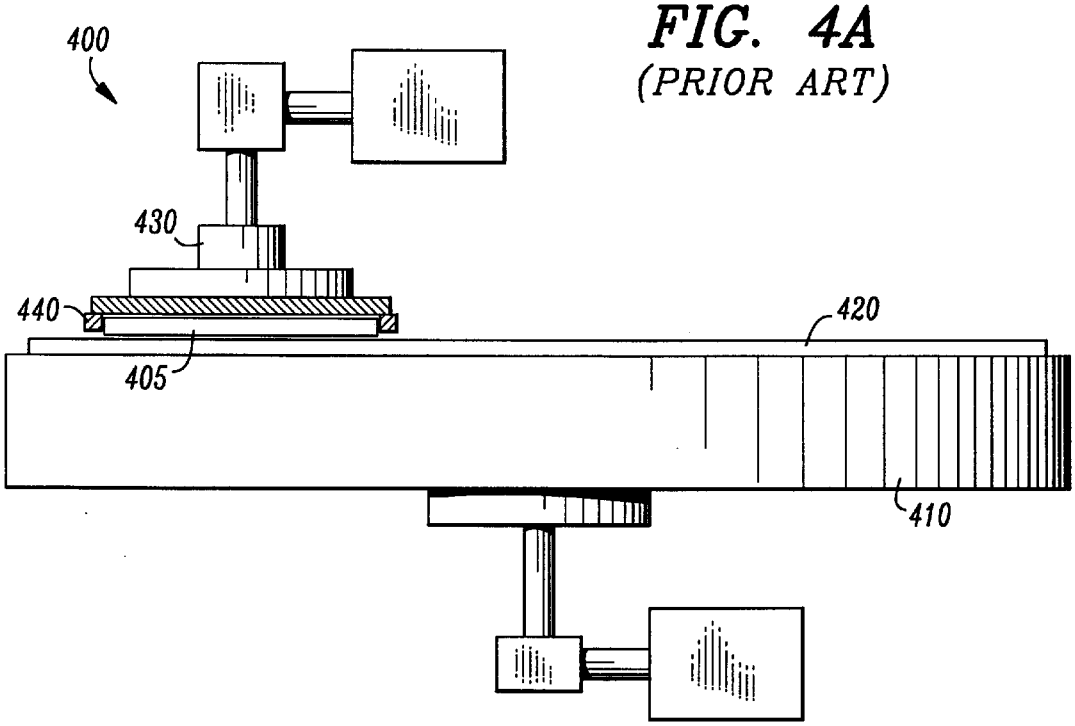
FIG. 4A (PRIOR ART)
FIG. 4A illustrates a sectional view of a conventional polishing apparatus polishing a semiconductor wafer.
Figure 4B:
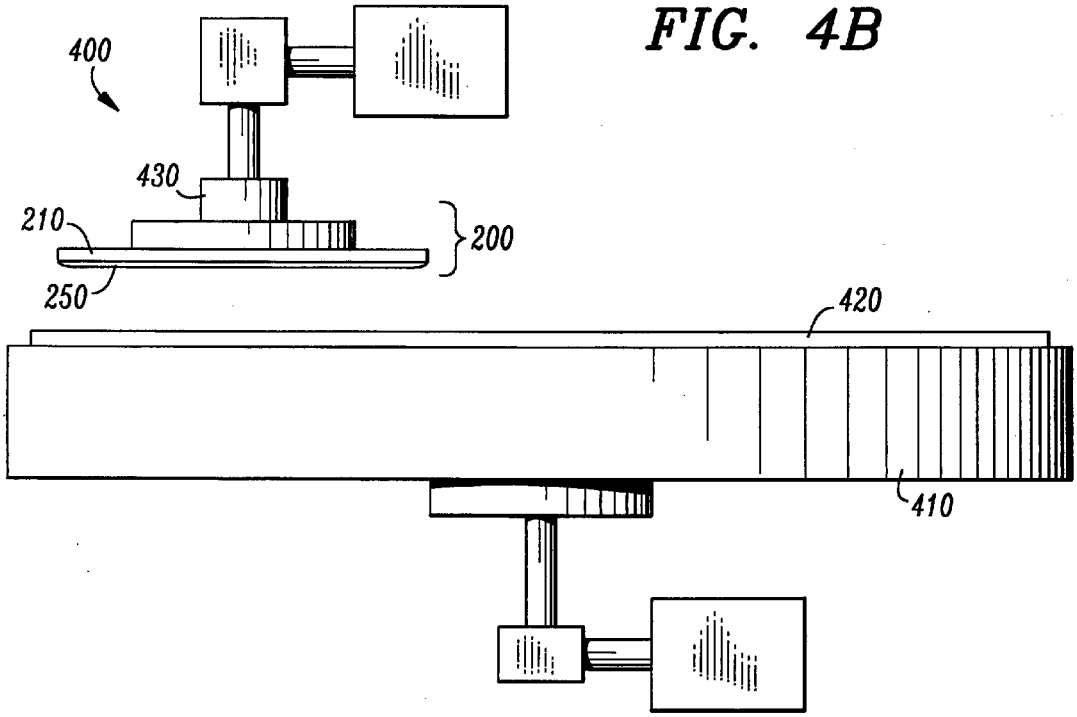
FIG. 4B illustrates a sectional view of the conventional polishing apparatus of FIG. 4A incorporating a conditioning wheel according to the present invention.

Referring now to FIGS. 4A and 4B, concurrently, illustrated is an example of a conventional polishing apparatus 400 that can be used to polish a semiconductor wafer 405, and that can be used in conjunction with the present invention. Those who are skilled in the art understand how to make and use the polishing apparatus 400, as well as how to condition a polishing pad. Basically, the polishing apparatus 400 includes a polishing platen 410 and a polishing pad 420 attached to the polishing platen 410 that is used to polish the semiconductor wafer 405, perhaps during a CMP process.

The polishing apparatus 400 further includes a carrier head 430. As illustrated in FIG. 4B, removably mounted to the carrier head 430 is the conditioning wheel 200 illustrated in FIGS. 2 and 3. The conditioning wheel 200 is removable so that the carrier head 430 may accommodate the semiconductor wafer 405, as shown in FIG. 4A. When the polishing effectiveness of the polishing pad 420 is lost or has diminished, the conditioning wheel 200, with the abrasive particles 240 and the retainer coating 250 of the present invention, is mounted to the carrier head 430 and used to condition the polishing pad 420. In such instances, the full polishing potential of the polishing pad 420 is realized for each wafer undergoing the CMP process. In other embodiments, the conditioning wheel 200 is a complete assembly, incorporating the carrier head 430 as part of a single assembly. In addition, other assemblies incorporating the conditioning wheel 200 are also encompassed by the present invention.

After the polishing pad 420 has been used to polish numerous semiconductor wafers 405, its polishing surface will eventually degrade to the point of requiring conditioning to return its polishing efficiency. In such instances, the conditioning wheel 200 as covered by the present invention is attached to the carrier head 430 and used to condition the polishing pad 420.

When conditioning of the polishing pad 420 is completed, the conditioning wheel 200 is removed from the carrier head 430 and a carrier ring 440 is reattached to the carrier head 430 and the polishing process on the semiconductor wafer 405 is resumed. This conditioning procedure is, of course, repeated whenever necessary. However, as discussed above, the retainer coating 250 continues to inhibit the abrasive particles 240 from becoming dislodged and falling away from the upper surface 220 of the conditioning wheel 200, even when the conditioning process is repeated a significant number to times. As a result, the conditioning wheel 200, according to the principles of the present invention, prevents the abrasive particles 240 from becoming embedded in the polishing pad 420 and contaminating the future polishing of other semiconductor wafers 405.

Thus, with the durability of the retainer coating 250 securing the abrasive particles 240 in the upper surface 220, the conditioning wheel 200 of the present invention may be used to condition significantly more polishing pads 420 than conditioning wheels found in the prior art. This conditioning can be done without the risk of contaminating those polishing pads 420 and damaging the semiconductor wafers 405 with dislodged abrasive particles 240, as typically occurs with prior art conditioning wheels.

Although the present invention has been described in detail, referring to several embodiments, those skilled in the art should understand that they can make various changes, substitutions and alterations herein without departing from the spirit and scope of the invention in its broadest form.

What is claimed is:

1. A polishing pad conditioning wheel, comprising:

a planar body having a metal surface located thereon, the metal surface having abrasive particles embedded therein; and a retainer coating consisting of silicon carbide deposited over the metal surface and at least partially over the abrasive particles to inhibit the abrasive particles from dislodging during a conditioning process.

2. The polishing pad conditioning wheel as recited in claim 1 wherein the abrasive particles are diamond particles.

3. The polishing pad conditioning wheel as recited in claim 1 wherein the silicon carbide coating is a chemical vapor deposition silicon carbide coating.

4. The polishing pad conditioning wheel as recited in claim 1 wherein the metal surface is stainless steel.

5. The polishing pad conditioning wheel as recited in claim 1 wherein the metal surface is a nickel-chrome alloy.

6. The polishing pad conditioning wheel as recited in claim 1 wherein the planar body has an annular configuration.

7. The polishing apparatus as recited in claim 1 wherein the retainer coating is an abrasive coating.

8. A polishing apparatus, comprising:

a carrier head coupled to a motor;

a polishing platen;

a polishing pad located on the polishing platen; and a conditioning wheel couplable to the carrier head, the conditioning wheel including:

a planar body having a metal surface located thereon, the metal surface having abrasive particles embedded therein; and a retainer coating consisting of silicon carbide deposited over the metal surface and at least partially over the abrasive particles to inhibit the abrasive particles from dislodging during a conditioning process.

9. The polishing apparatus as recited in claim 8 wherein the abrasive particles are diamond particles.

10. The polishing apparatus as recited in claim 8 wherein the silicon carbide coating is a chemical vapor deposition silicon carbide coating.

11. The polishing apparatus as recited in claim 8 wherein the metal surface of the planar body is stainless steel or a nickel-chrome alloy.

12. A method of conditioning a polishing pad, comprising:

coupling a conditioning wheel having a metal surface located thereon with abrasive particles embedded therein to a carrier head of a polishing apparatus;

placing the conditioning wheel against a polishing pad; and conditioning the polishing pad with a retainer coating consisting of silicon carbide deposited over the metal surface and the abrasive particles.

13. The method as recited in claim 12 wherein conditioning includes conditioning the polishing pad with diamond particles.

* * * * *